US008322553B2

(12) United States Patent
Rider, Jr. et al.

(10) Patent No.: US 8,322,553 B2
(45) Date of Patent: Dec. 4, 2012

(54) SELF-VENTING CONTAINER HAVING A LID THAT REMAINS ATTACHED TO A BASE DURING VENTING

(75) Inventors: Edward W. Rider, Jr., Slate Hill, NY (US); Brian S. Allers, Poughkeepsie, NY (US); Michael V. Warner, Hawley, PA (US)

(73) Assignee: Genpak LLC, Glens Falls, NY (US)

( * ) Notice: Subject to any disclaimer, the term of this patent is extended or adjusted under 35 U.S.C. 154(b) by 490 days.

(21) Appl. No.: 12/337,518

(22) Filed: Dec. 17, 2008

(65) Prior Publication Data

US 2010/0147848 A1 Jun. 17, 2010

(51) Int. Cl.
*B65D 51/16* (2006.01)

(52) U.S. Cl. ..... 220/203.09; 220/309.2; 220/366.1; 220/745; 220/784; 220/785; 220/799; 220/835

(58) Field of Classification Search ..... 215/307; 220/89.1, 203.09, 366.1, 745, 309.2, 784, 220/785, 799, 835
See application file for complete search history.

(56) References Cited

U.S. PATENT DOCUMENTS

| | | | | | |
|---|---|---|---|---|---|
| 367,250 | A | * | 7/1887 | Sperry | 222/465.1 |
| 2,126,390 | A | * | 8/1938 | Jackson | 215/41 |
| 2,138,376 | A | * | 11/1938 | Griswold | 215/260 |
| 2,423,295 | A | * | 7/1947 | Crabbe et al. | 215/260 |
| 2,424,801 | A | * | 7/1947 | Crabbe et al. | 215/260 |
| 2,629,421 | A | * | 2/1953 | Ayres | 72/360 |
| 2,644,443 | A | * | 7/1953 | Barnsteiner | 126/19 R |
| 3,028,039 | A | * | 4/1962 | Clark | 220/366.1 |
| 3,042,247 | A | * | 7/1962 | Bonnet | 220/366.1 |
| 3,061,139 | A | * | 10/1962 | Edwards | 220/203.09 |
| 3,181,720 | A | * | 5/1965 | Cassie et al. | 215/260 |
| 3,214,068 | A | * | 10/1965 | Armour | 222/486 |
| 3,302,822 | A | * | 2/1967 | Edwards | 220/203.09 |
| 3,342,385 | A | * | 9/1967 | Knight | 222/485 |
| 3,381,872 | A | * | 5/1968 | Holder et al. | 220/203.09 |
| 3,403,828 | A | * | 10/1968 | Frank | 222/486 |
| 3,433,379 | A | * | 3/1969 | Anatoly et al. | 215/260 |
| 3,447,725 | A | * | 6/1969 | Armour | 222/486 |
| 3,467,288 | A | * | 9/1969 | Croyle | 222/480 |
| 3,613,938 | A | * | 10/1971 | Westcott | 220/785 |
| 3,632,004 | A | * | 1/1972 | Grimes et al. | 215/232 |
| 3,670,922 | A | * | 6/1972 | Phillips | 206/519 |
| 3,773,207 | A | | 11/1973 | Dokoupil et al. | |
| 3,857,506 | A | * | 12/1974 | Hafele | 215/46 |
| 3,858,756 | A | * | 1/1975 | Fulton | 220/374 |
| 4,022,464 | A | * | 5/1977 | Parker | 222/485 |
| 4,058,214 | A | * | 11/1977 | Mancuso | 206/545 |
| 4,192,429 | A | * | 3/1980 | Yerman | 215/307 |
| 4,660,734 | A | * | 4/1987 | Heaney et al. | 220/657 |
| 4,770,318 | A | * | 9/1988 | Earl | 220/785 |
| 5,056,681 | A | * | 10/1991 | Howes | 220/522 |
| 5,105,947 | A | * | 4/1992 | Wise | 206/519 |
| 5,392,948 | A | * | 2/1995 | McEntee | 220/669 |

(Continued)

*Primary Examiner* — J. Gregory Pickett
*Assistant Examiner* — Ned A Walker
(74) *Attorney, Agent, or Firm* — Stoel Rives LLP

(57) ABSTRACT

A container can include a base, a lid, and one or more vents. The lid can be removed from the base and can be reattached to the base. Moreover, when the lid is attached to the base, it can permit self-venting of the container. Pressure within the container can cause the lid to move relative to the base so as to open the vents while the lid remains coupled with the base.

18 Claims, 7 Drawing Sheets

U.S. PATENT DOCUMENTS 5,397,024 A * 3/1995 Wu et al. ..... 220/231
5,570,797 A * 11/1996 Yeh ..... 215/228
5,628,427 A * 5/1997 Hayes ..... 220/669
5,686,127 A * 11/1997 Stockley et al. ..... 426/129
5,746,337 A * 5/1998 Haist ..... 215/44
5,785,196 A * 7/1998 Montgomery ..... 215/354
5,860,549 A * 1/1999 Allers et al. ..... 220/4.23
6,041,982 A * 3/2000 Cautereels et al. ..... 222/562
6,102,225 A * 8/2000 Lynn ..... 215/252
6,202,870 B1 * 3/2001 Pearce ..... 215/307
6,202,871 B1 * 3/2001 Kelly ..... 215/307
6,349,843 B1 * 2/2002 Mittmann et al. ..... 220/573.4
6,372,273 B1 * 4/2002 Mabry et al. ..... 426/129
6,557,720 B2 * 5/2003 Roberts et al. ..... 220/657
6,568,534 B2 * 5/2003 Zank ..... 206/508
D478,282 S * 8/2003 Hayes et al. ..... D9/425
6,877,625 B2 * 4/2005 Alley ..... 215/307
6,966,468 B2 * 11/2005 McKay et al. ..... 222/486
7,121,420 B2 10/2006 Baudin
7,337,916 B2 * 3/2008 Clougherty ..... 220/785
7,337,929 B2 * 3/2008 Winckels ..... 222/548
2003/0062329 A1 * 4/2003 Alley ..... 215/307
2005/0139090 A1 6/2005 Clougherty

* cited by examiner

SELF-VENTING CONTAINER HAVING A LID THAT REMAINS ATTACHED TO A BASE DURING VENTING

TECHNICAL FIELD

Embodiments disclosed herein relate generally to sealable containers.

BRIEF DESCRIPTION OF THE DRAWINGS

The written disclosure herein describes illustrative embodiments that are non-limiting and non-exhaustive. Reference is made to certain of such illustrative embodiments that are depicted in the figures, in which.

DETAILED DESCRIPTION

Figure 1:
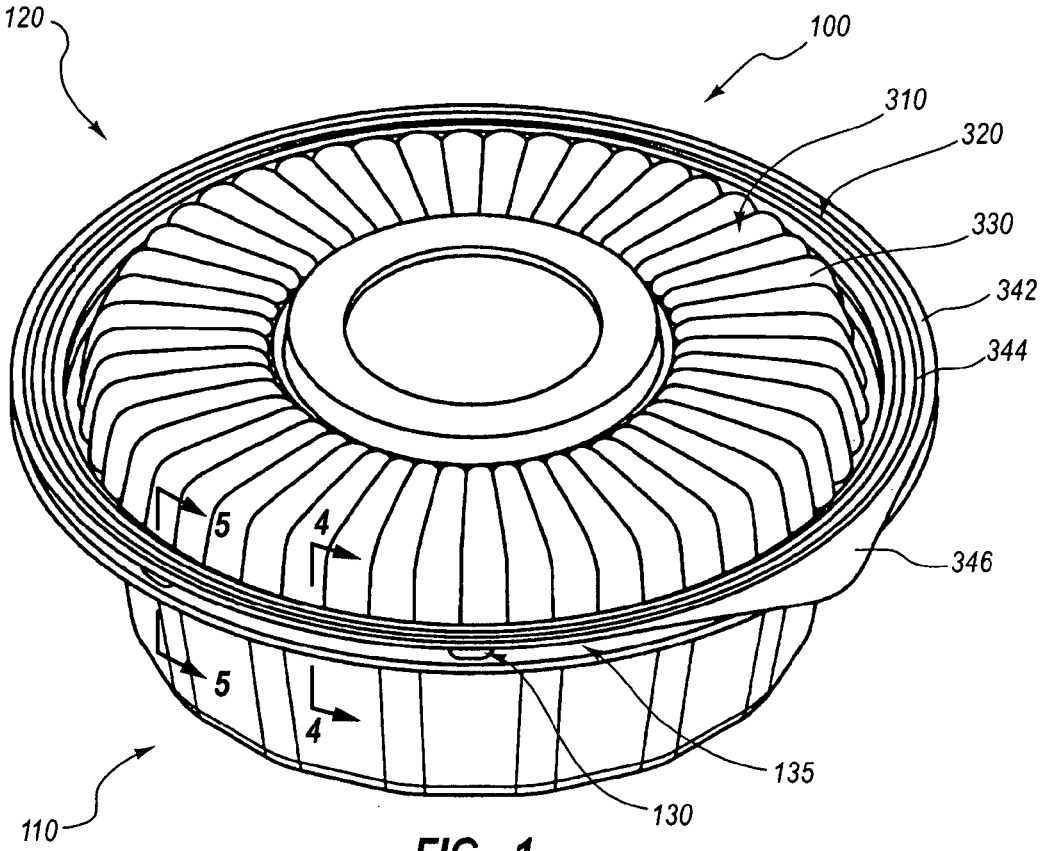
FIG. 1 is a perspective view of an embodiment of a sealable container configured for venting.

With reference to FIG. 1, in certain embodiments, a container 100 comprises a base 110 and a lid 120. As discussed in greater detail below, the lid 120 can be configured to engage the base 110 in at least two separate engagement configurations such that in a first engagement configuration, the lid 120 and the base cooperate to form a substantially fluid-tight and/or substantially airtight seal, and in a second engagement configuration, the lid 120 and the base remain engaged with each other while permitting fluid communication between an interior of the container 100 and an environment outside of the container. In further embodiments, the lid 120 can be fully removable from the base 110 and can capable of reconnection with the base 110 such that, for example, a food product or some other product can be placed in the container 100 and sealed inside.

In certain embodiments, the container 100 comprises one or more venting regions or vents 130 and one or more connection regions or substantially non-venting regions 135. The substantially non-venting regions 135 are also referred to herein as non-venting regions 135 for purposes of convenience, although in some embodiments, the non-venting regions can provide relatively small amounts of venting. In certain embodiments, the vents 130 are closed and substantially prevent fluid communication between an interior and an exterior of the container 100 when the lid 120 and the base 110 are attached in the first engagement configuration. In further embodiments, the vents 130 are open and permit fluid communication between an interior of the container 100 and an exterior of the container 100 when the lid 120 and the base 110 are attached in the second engagement configuration. The non-venting regions 135 can maintain a connection between the lid 120 and the base 110.

In the illustrated embodiment, the container 100 is substantially circular. For example, each of the base 110 and the lid 120 defines a substantially circular portion, and the respective diameters of the circular portions are roughly equal. Other arrangements of the container 100 are possible. For example, in various embodiments, the base 110 and the lid 120 can define complementary shapes that are substantially rectangular, substantially square, substantially ovoid, or any other suitable shape. In further embodiments, portions of the base 110 and the lid 120 are complementary and other portions are non-complementary, and the base 110 and the lid 120 need not define the same general shape.

Figure 2:
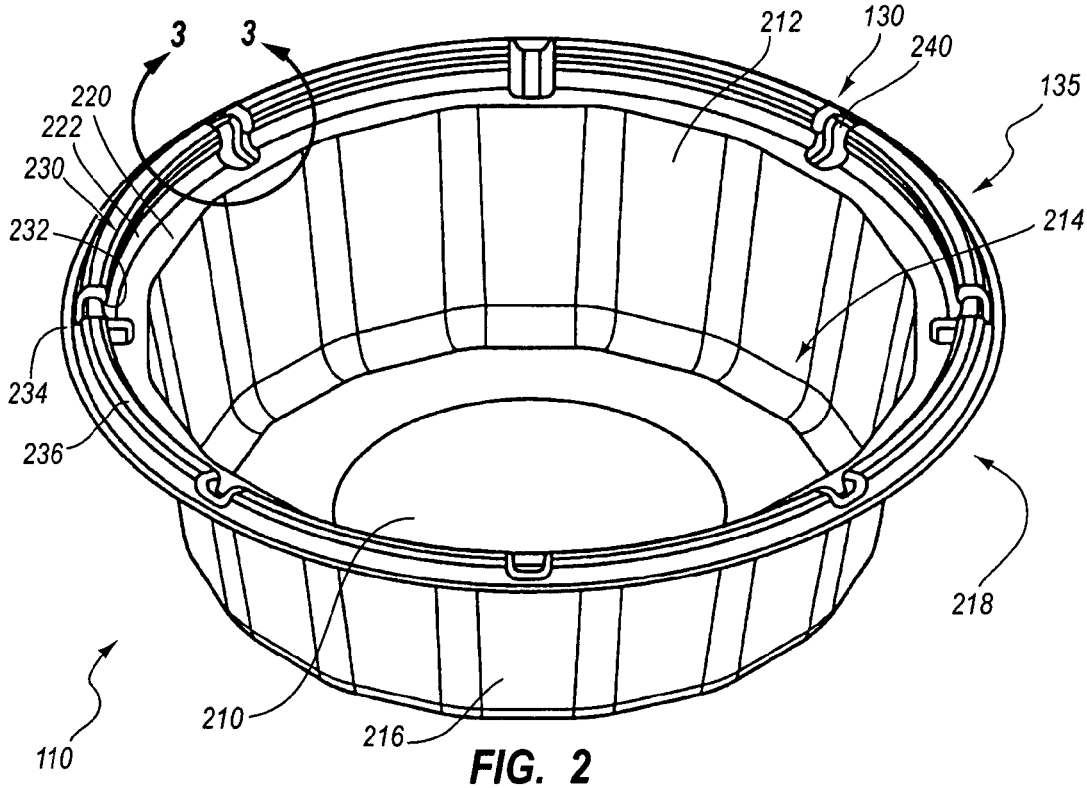
FIG. 2 is a perspective view of an embodiment of a base compatible with the container of FIG. 1.
Figure 3:
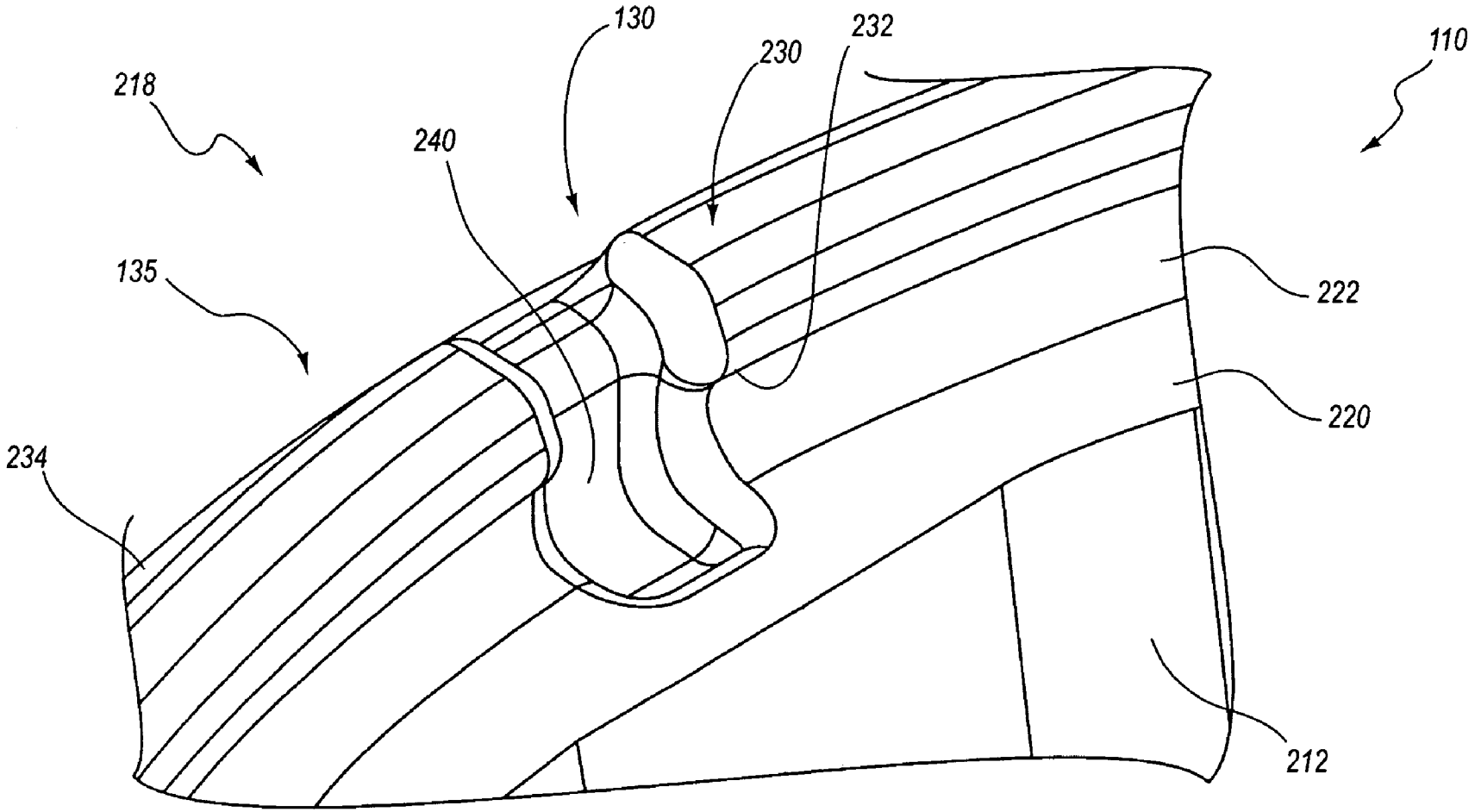
FIG. 3 is a perspective view of a portion of the base of FIG. 2 within the region demarcated by the view line 3 shown in FIG. 2.
Figure 4:
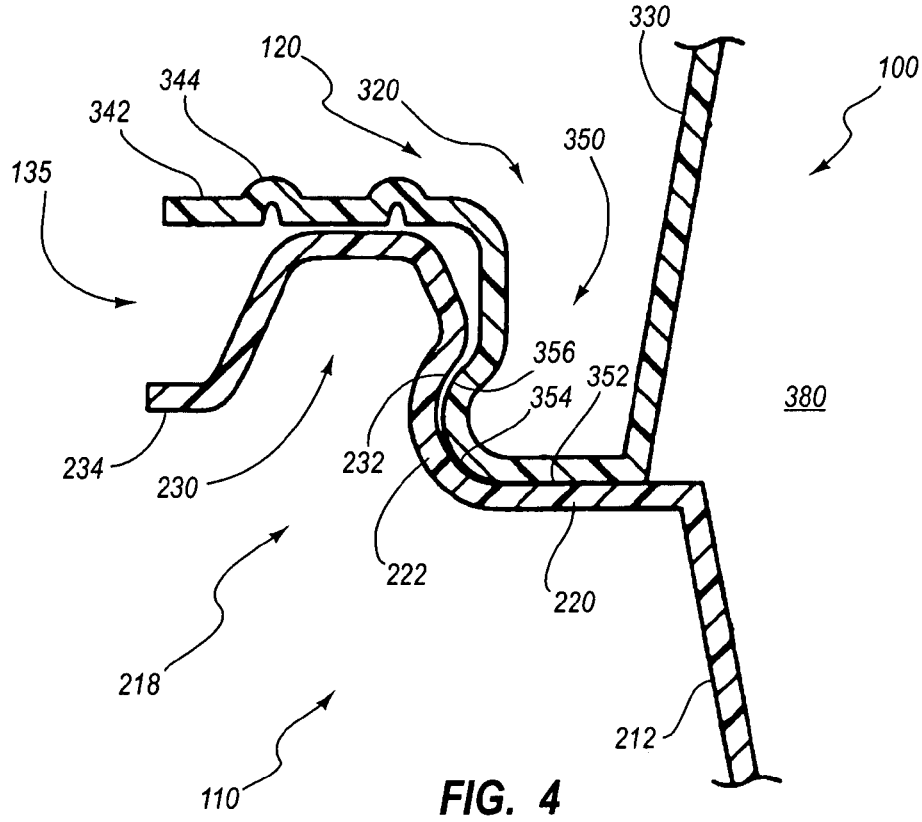
FIG. 4 is a cross-sectional view of a non-venting region of the container of FIG. 1 under relatively low pressure conditions inside the container taken along the view line 4-4 shown in FIG. 1.

With reference to FIGS. 2, 3, and 4, in certain embodiments, the base 110 defines a bottom surface 210 and a sidewall 212 that extends upwardly from the bottom surface 210. Directional terms, such as bottom, upwardly, etc., are used herein by way of convenience and not limitation. While these terms can correspond with the orientations of various illustrative embodiments, as depicted in the figures and as described, it is noted that other suitable arrangements and orientations are possible.

The bottom surface 210 and the sidewall 212 can define any suitable arrangement and can be configured to define a cavity 214 (see FIG. 2). A variety of volumes are possible for the cavity 214. For example, in various embodiments, the cavity 214 can have a volume of from about 0.25 liters to about 3.0 liters or any subset of ranges therein, less than about 0.25 liters, less than about 0.5 liters, less than about 1.0 liters, less than about 1.5 liters, less than about 2.0 liters, less than about 3.0 liters, greater than about 0.25 liters, greater than about 0.5 liters, greater than about 1.0 liters, greater than about 1.5 liters, greater than about 2.0 liters, greater than about 3.0 liters, about 0.25 liters, about 0.5 liters, about 0.75 liters, about 1.0 liters, about 1.5 liters, about 2.0 liters, or about 3.0 liters. Volumes other than those listed are also possible.

In various embodiments, the bottom surface 210 and/or the sidewall 212 can be substantially smooth, and in other embodiments, can be textured, angled, or ornamented. For example, in the illustrated embodiment the sidewall 212 defines a series of substantially planar panels 216 (see FIG. 2).

With continued reference to FIGS. 2, 3, and 4, in certain embodiments, the base 110 can include a connection region, such as a peripheral extension 218, at an upper end thereof. In some embodiments, portions of the peripheral extension 218 can extend upwardly and outwardly from the sidewall 212. For example, in the illustrated embodiment, the peripheral extension 218 comprises a ledge 220 that extends outwardly from the sidewall 212. In some embodiments, the ledge 220 can define a planar surface that is substantially parallel to a plane defined by a bottommost portion of the bottom surface 210 of the base 210. In other embodiments, the ledge 220 can be rounded, angled, or otherwise substantially non-planar, and can define an angle relative to a plane defined by the bottommost portion of the bottom surface 210.

In certain embodiments, the ledge 220 transitions outwardly and upwardly via a transition region 222 of a lip 230. In some embodiments, the transition region 222 is substantially rounded and can define a radius of curvature. The lip 230 can define a lower edge 232. The term "edge" is used expansively herein, is intended to include the ordinary meaning of this term, and can include bands of surface portions having various widths and dimensions. The lip 230, or a portion thereof, can define a substantially trapezoidal cross-section (see FIG. 4). In some embodiments a flange 234 extends outwardly from the lip 230. Other suitable arrangements and configurations of the peripheral extension 218 are possible. For example, in various embodiments, the transition region 222 can define different radii of curvature or can be substantially flat, and/or the lip 230 can define other cross-sectional shapes, such as, for example, substantially semicircular or substantially rectangular shapes.

Figure 5:
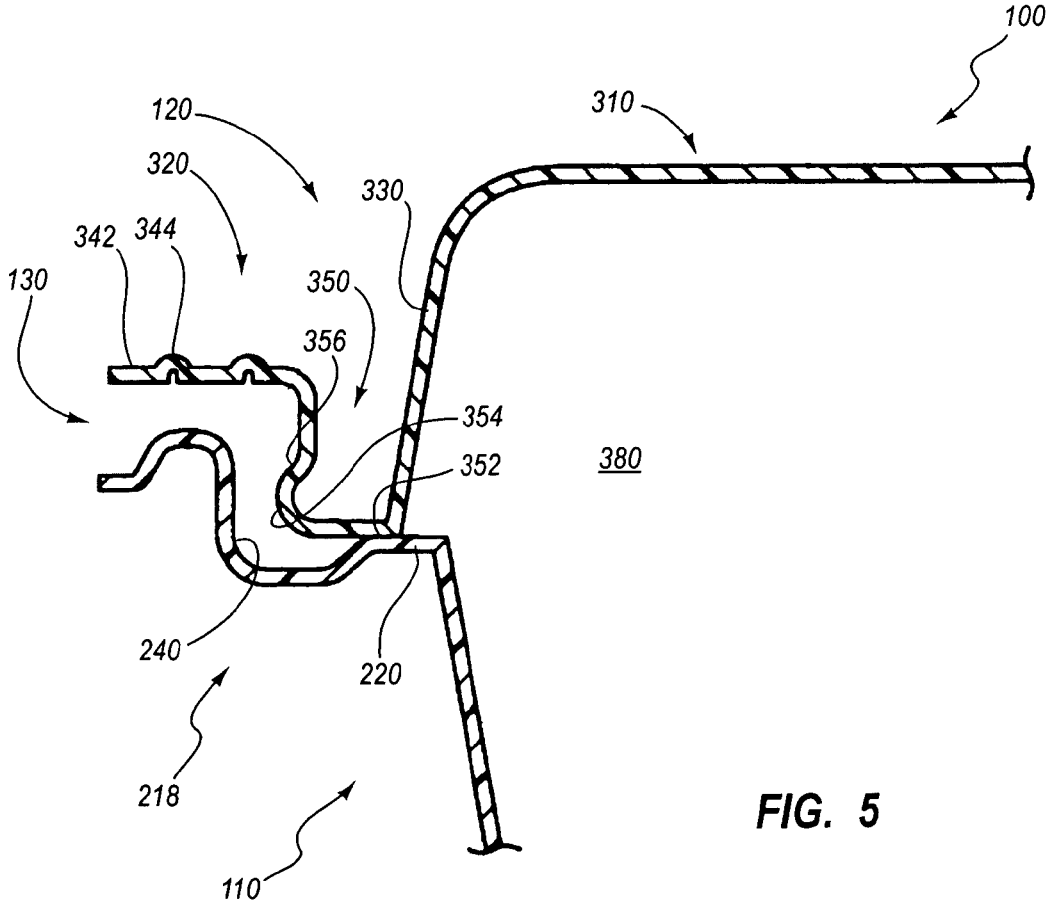
FIG. 5 is a cross-sectional view of a venting region of the container of FIG. 1 under relatively low pressure conditions inside the container taken along the view line 5-5 shown in FIG. 1.

With reference to FIGS. 2, 3, and 5, in certain embodiments, the base 110 can define at least a portion of a vent 130. For example, in some embodiments, the vent 130 is defined by portions of the peripheral extension 218. The vent 130 can comprise a depression 240 (e.g., a concavity, indentation, valley, or other structural recess) that can interrupt, bifurcate, or otherwise separate portions of the peripheral extension 218. For example, as can be seen in FIGS. 2 and 3, in the illustrated embodiment, a vent 130 can be defined by a depression 240 that extends through (e.g., between) and separates adjacent sections of the lip 230. As can be seen in FIG. 2, a topmost edge 236 of the lip 230 and the lower edge 232 of the lip 230 can both be interrupted by one or more depressions 240. The lip 230, or portions thereof (e.g., the lower edge 232 and/or the topmost edge 236), can extend about a full perimeter of the base 110 in a discontinuous fashion. The term "perimeter" is used expansively herein, includes the ordinary meaning of this term, and can include a line or a wider region that extends about an entire portion of an item (e.g., about a portion located within a peripheral edge of the item) or about an entire item itself (e.g., about a peripheral edge of the item).

With continued reference to FIG. 2, in certain embodiments, the depression 240 can extend into a portion of the ledge 220. However, in some embodiments the ledge 220 (or a portion thereof) extends about a full perimeter of the base 110 substantially without interruptions, or in a substantially continuous fashion. For example, in the illustrated embodiment, an innermost strip of the ledge 220 extends about a full perimeter of the base 110 without interruptions in the surface thereof by the depressions 240.

With reference to FIGS. 1, 4, and 5, in certain embodiments, the lid 120 defines an inner region 310. The lid 120 can further define a connection region, such as, for example, a peripheral extension 320 that depends from the inner region 310. The inner region 310 can include substantially planar regions, one or more depressed features, and/or one or more raised features in any suitable combination. In some embodiments an arrangement of depressed and/or raised features can be ornamental and/or structural. For example, in the illustrated embodiment, a series of raised ribs 330 project outwardly from a central region of the lid 120 in a spoke-like fashion. The raised ribs 330 can provide structural rigidity to the lid 120. Other arrangements are possible.

In certain embodiments, the peripheral extension 320 can comprise a flange 342. In some embodiments, the flange 342 comprises one or more ribs 344, which can provide the flange 342 with structural rigidity. For example, the ribs 344 can prevent or inhibit tearing of the flange 342. In some embodiments, the flange 342 can define a tab 346 that extends outwardly relative to the inner region 310 of the lid 120 (see FIG. 1). The tab 346 can extend outwardly beyond any portion of the base 110, and can provide a convenient surface for grasping in order to remove the lid 120 from the base 110.

With reference to FIGS. 4 and 5, in certain embodiments, the peripheral extension 320 of the lid 120 can define a rim 350. In some embodiments, the rim 350 extends about a full perimeter of the lid 120 in a continuous fashion. For example, in the illustrated embodiment, the rim 350 can define substantially the same cross-sectional profile about a full periphery of the lid 120.

In some embodiments, the rim 350 includes a lower surface 352 configured to abut the ledge 220 of the base 110. In certain embodiments, the rim 350 includes a transition region 354 extending from the lower surface 352 that can be configured to interact with the transition region 222 of the base 110. The transition regions 354, 222 may be compatible with and/or complementary to each other so as to provide a snap-fit or friction-fit engagement that tightly secures the lid 120 to the base 110. For example, in some embodiments, an outwardly facing surface of the transition region 354 of the lid 120 can be configured to fit snugly within an inwardly facing surface of the transition region 222 of the base 110. In the embodiment illustrated in FIG. 4, the transition region 354 of the lid 120 defines a radius of curvature that is smaller than a radius of curvature defined by the transition region 220 of the base 110, which can allow for a small gap between an outwardly facing surface of the transition region 354 and an inwardly facing surface of the transition region 222.

In some embodiments, the rim 350 includes an upper edge 356. In some embodiments, the upper edge 356 extends about a perimeter of the lid 120 in a substantially continuous fashion. As further discussed below, the upper edge 356 can be configured to interact with the lower edge 232 of the base 110.

With continued reference to FIGS. 4 and 5, the lid 120 and the base 110 can cooperate to define an interior volume 380 of the container 100 when the lid 120 and the base 110 are attached to each other. In some embodiments, the lid 120 is free of openings between an interior surface that faces the interior volume 380 and an exterior surface that faces an environment outside of the container 100. In certain of such embodiments, the lid can substantially prevent fluid communication between the interior volume 380 and the outside environment through the lid 120 when the lid 120 is coupled with the base 110.

As previously discussed, in various embodiments, the lid 120 and the base 110 can be configured to attach to one another in at least two separate attachment configurations. As further discussed hereafter, the attachment configuration by which the lid 120 and the base 110 are joined can depend on a pressure level within the interior volume 380, as compared with a pressure level of an environment outside of the container 100. In further embodiments, the lid 120 can be configured to be fully removed from the base 110 such that an item can be placed in or removed from the container 100. The lid 120 can be further configured to be secured to the base 110 after having been removed from the base 110 such that the lid 120 and the base 130 are resealable.

Stated otherwise, in some embodiments, the lid 120 and the base 110 can be configured to interact with each other in three separate modes or configurations, and in further embodiments, it is possible to repeatedly transition among the configurations, which can include: a separated configuration in which the lid 120 and the base 110 are detached from one another; an attached-and-closed configuration in which the lid 120 and the base 110 cooperate to form a substantially liquid-tight or a substantially airtight seal (e.g., the lid 120 and the base 110 form a full or complete seal); and an attached-and-vented configuration in which the lid 120 and the base 110 are maintained in a joined configuration while permitting gas to escape from the interior volume 380 of the container 100 into an environment surrounding the container 100 (e.g., the lid 120 and the base 110 form a partial or interrupted seal).

Figure 6:
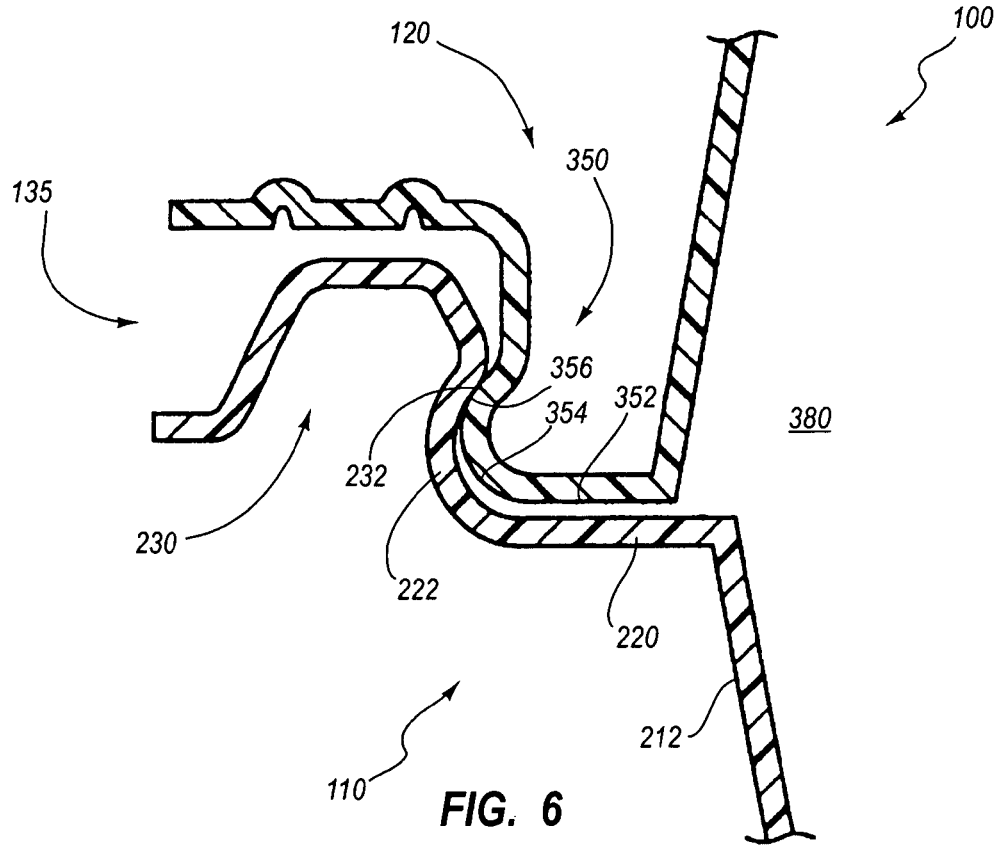
FIG. 6 is a cross-sectional view of a non-venting region of the container of FIG. 1 under relatively high pressure conditions inside the container taken along a view line such as the view line 4-4 shown in FIG. 1.
Figure 7:
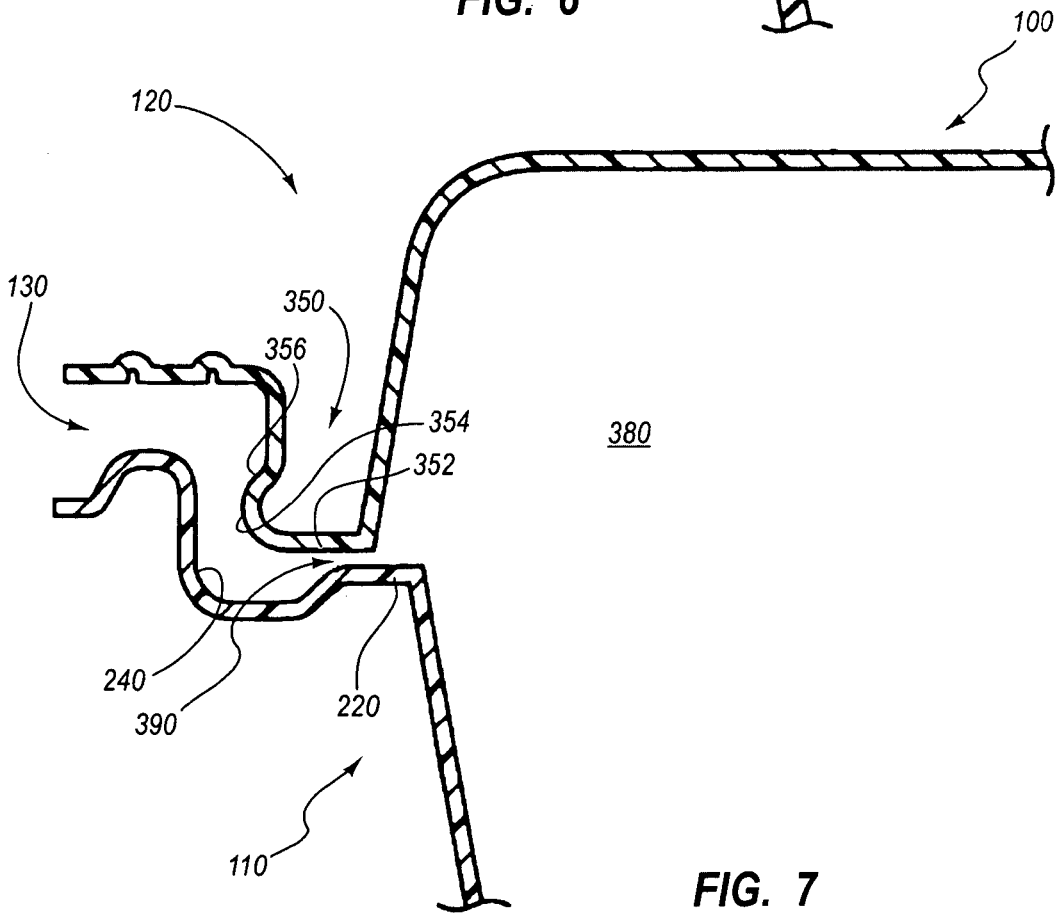
FIG. 7 is a cross-sectional view of a venting region of the container of FIG. 1 under relatively high pressure conditions inside the container taken along a view line such as the view line 5-5 shown in FIG. 1.

FIGS. 4 and 5 depict an embodiment of the container 100 in an illustrative attached-and-closed configuration, and FIGS. 6 and 7 depict an embodiment of the container 100 in an illustrative attached-and-vented configuration. FIGS. 4 and 6 depict cross-sections through a non-venting region 135 of the container 100, such as that shown by the view line 4-4 of FIG. 1, and FIGS. 5 and 7 depict cross-sections through a venting region 130 of the container 100, such as that shown by the view line 5-5 of FIG. 1.

As illustrated in FIG. 4, in certain embodiments, when the container 100 is in the attached-and-closed configuration, the lower surface 352 of the rim 350 of the lid 120 contacts the ledge 220 of the base 110. Interaction of the transition region 354 of the lid 120 and the transition region 222 of the base 110 can be such that the lower surface 352 and the ledge 220 are held together in a substantially fluid-tight or, in further embodiments, in a substantially airtight seal. The seal can substantially prevent fluid communication between the interior volume 380 of the container and a region outside of the container 100.

As illustrated in FIG. 5 and as discussed above, in certain embodiments, each of the rim 350 and at least a portion of the ledge 220 extends about a perimeter of the container 100 in a substantially continuous fashion such that the substantially fluid-tight or substantially airtight seal between the lid 120 and the base 110 also extends about the perimeter of the container 100. For example, as shown in FIG. 5, even in the venting region 130, the lower surface 352 of the rim 350 can interact with the ledge 220 to form a seal therewith when the container 100 is in the attached-and-closed configuration.

In some embodiments, a seal can be formed in the venting region 130 despite a lack of interaction between the transition region 354 of the lid 120 and the transition region 222 of the base 110 in the vicinity of the venting region 130. For example, as previously discussed, in some embodiments, the venting region 130 is defined by the depression 240, which can interrupt the transition region 222 (see FIG. 2). However, in many embodiments, portions of the transition region 222 that neighbor the venting region 130 can provide sufficient interaction with the lid 120 to maintain a seal between the lid 120 and the base 110 in the vicinity of the venting region 130.

In certain embodiments, the container 100 is maintained in the attached-and-closed configuration when a difference between a pressure within the interior volume 380 and a region or environment outside of the container 100 is at or less than a threshold value. In further embodiments, the container 100 can transition to the attached-and-vented configuration when a difference between a pressure within the interior volume 380 and an environment outside of the container 100 is above the threshold value. In still further embodiments, the container 100 can transition from the attached-and-vented configuration to the attached-and-closed configuration when a difference between a pressure within the interior volume 380 and an environment outside of the container 100 drops below the threshold value.

The term "threshold value" is used expansively herein, is intended to include the ordinary meaning of this term, and can include a value representing a benchmark pressure differential at which transition between attachment states can occur and which, in some embodiments, can be predetermined. For example, a threshold value can represent a known or predetermined gauge pressure, as measured within the container 100, at which the container 100 can transition between the attached-and-closed configuration and the attached-and-vented configuration.

As an illustrative and non-limiting example, in many embodiments, the lid 120 and the base 110 can be in the separated state, an item (e.g., a food item) can be placed in the cavity 214 (see FIG. 2) defined by the base 110, and the lid 120 can then be joined to the base 110. Once the lid 120 is sealed to the base 110 such that the container 100 is in the attached-and-closed configuration, the interior volume 380 and the environment at an exterior of the container 100 can be at about the same pressure or at substantially the same pressure. If the container 100 and its contents are then heated, in some embodiments, as the temperature of the item rises, steam or other gases can be released from the heated item and build pressure within the container 100. Pressure generated within the container 100 can eventually build such that pressure within the container 100 is greater than pressure outside of the container 100 by a sufficient amount to expand the container 100. For example, the pressure differential can be sufficient to move the lid 120 away from the base 110 without fully separating the lid 120 from the base 110. In some embodiments, the container 100 transitions from the attached-and-closed state to the attached-and-vented state when a pressure within the container 100 is substantially greater than an environmental pressure, and in other embodiments, the transition occurs when the internal pressure is only slightly greater than the environmental pressure. In many embodiments, the lid 120 is configured to remain attached to the contain 100 as additional pressure is generated within the container 100 while the container 100 is in the attached-and-vented state.

In some embodiments, the container 100 can be stored in the attached-and-closed state in any suitable storage area, such as, for example, a freezer, refrigerator, or cupboard. The container 100 can be moved from the storage area directly to an oven (e.g., a microwave oven) without first manipulating the lid 120 into a vented configuration. As the contents of the container 100 are heated, the container 100 can automatically transition to the attached-and-vented state, and can permit venting of the contents while inhibiting or substantially preventing splattering of the contents.

FIGS. 6 and 7 illustrate an embodiment of the container 100 in which the pressure within the container 100 is greater than the pressure outside of the container 100 by an amount sufficient to have moved the lid 120 away from the base 110 without separating the lid 120 from the base 110. As previously mentioned, the embodiment of the container 100 depicted in FIGS. 6 and 7 is an illustrative example of an attached-and-vented configuration.

As shown in FIG. 6, in a non-venting region 135 of the container 100, a gap 390 can form between the lower surface 352 of the rim 350 of the lid 120 and the ledge 220 of the base 110 such that gas within the interior volume 380 of the container 100 can move between the rim 350 and the ledge 220. However, in some embodiments, interaction between the lower edge 232 of the lip 230 and the upper edge 356 of the rim 350 may be sufficient to form a substantially fluid-tight or substantially airtight seal. Such a seal between the lid 120 and the base 110 in the non-venting region 135 can substantially prevent fluid communication between the interior volume 380 of the container 100 and an exterior environment via the non-venting region 135. Interaction between the lower edge 232 of the lip 230 and the upper edge 356 of the rim 350 can prevent the lid 120 from separating from the base.

In certain embodiments, a portion of the base 110 in the non-venting region 135 (e.g., a portion of the transition region 222) contacts and/or seals with a portion of the lid 120 in the non-venting region 135 (e.g., a portion of the transition region 354) at every point in time during transition of the container 100 between the attached-and-closed configuration and the attached-and-vented configuration. For example, in some embodiments, a contact line or a contact region between an outwardly facing surface of the lid transition region 354 of the lid 120 and an inwardly facing surface of the transition region 222 of the base 110 can incrementally advance from a position near the bottom of the transition regions 354, 222 to a position near the top of the transition regions 352, 222.

As shown in FIG. 7, in certain embodiments, the lid 120 is spaced from the base 110 in the venting region 130 when the container 100 is in the attached-and-vented state. The seal between the lid 120 and the base 110 discussed above with respect to FIG. 6 thus can be interrupted. For example, the seal between the lower edge 232 of the lip 230 and the upper edge 356 of the rim 350 can extend about a perimeter of the container 100 in a discontinuous fashion.

In certain embodiments, the gap 390 between the rim 350 and the ledge 220 can provide a passageway or channel between the interior volume 380 of the container 100 and an environment outside of the container 100. Specifically, in some embodiments, the gap 390 provides fluid communication between the interior volume 380 and an open region between the depression 240 of the base 100 and the rim 350 of the lid 120. Gas within the interior volume 380 can thus escape from the container 100 between the lid 120 and the base 110, or at in interface of the lid 120 and the base 110. In some embodiments, the gas can be directed peripherally outward from the container 100 (e.g., past an outer periphery of the lid 120 and past an outer periphery of the base 110). In some embodiments, the container 100 is capable of venting sufficient amounts of gas via one or more venting regions 130 such that additional pressure generated within the interior volume 380 is regulated below a level that could separate the lid 120 from the base 110.

In certain embodiments, when pressure generation in the interior volume 380 terminates or subsides by a sufficient amount, and/or when pressure levels within the container 100 have been reduced by a sufficient amount, the lid 120 can move toward the base 110. In some embodiments, the lid 120 moves toward the base 110 and forms a seal therewith when a difference between the pressure within the container 100 and the pressure of a surrounding environment drops below a threshold value. In certain embodiments, the container 100 can return to the attached-and-closed configuration such that a seal is formed between the ledge 220 of the base 110 and the rim 350 of the lid 120, as described above (e.g., with respect to FIGS. 4 and 5). In some embodiments, a container may transition between the attached-and-closed state and the attached-and-vented state multiple times during a single heating event.

Figure 8:
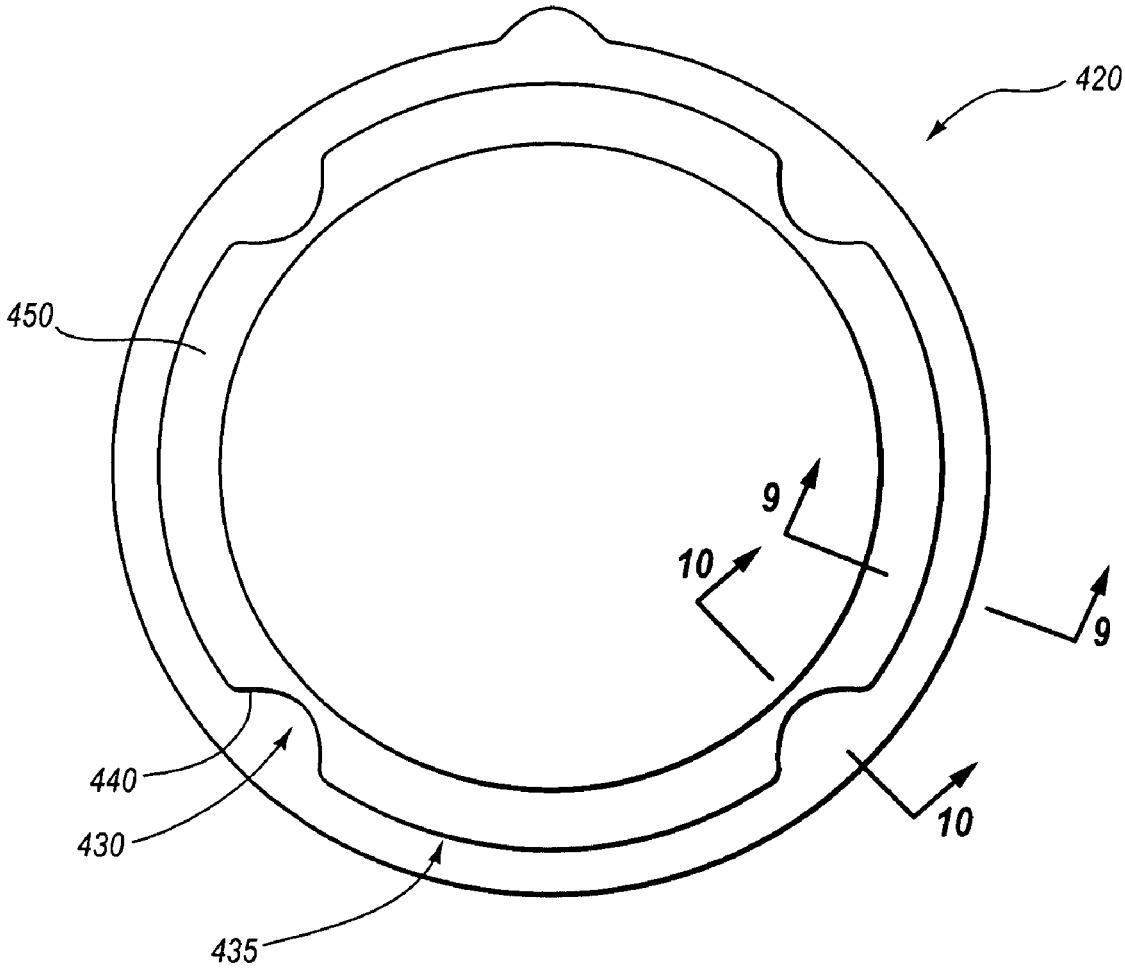
FIG. 8 is a bottom plan view of an embodiment of a lid configured for use with embodiments of a container.

FIG. 8 illustrates an embodiment of a lid 420 such as the lid 120 described above. The lid 420 can differ from the illustrated embodiment of the lid 120 in that the lid 420 comprises venting portions 430. For example, in certain embodiments, the lid 420 can comprise a rim 450 such as the rim 350, but which includes depressions 440 that curve inwardly (e.g., towards a central region of the lid 120). The lid 120 can also include non-venting portions 435.

In some embodiments, the lid 420 can be compatible with embodiments of the base 110. For example, the illustrated embodiment of the lid 420 can be joined with the base 110 such that the depressions 440 of the lid 420 are offset from the depressions 240 of the base 110. More or fewer depressions 440, 240 than those of the illustrated embodiments are possible. Depressions having other configurations and/or venting portions that do not include depressions are also possible.

In other embodiments, the lid 420 can be coupled with a base that does not include depressions 240 or is otherwise substantially free of venting portions. For example, as illustrated in FIGS. 9-12, in certain embodiments, a base 410 includes a lip 530 that defines a substantially constant cross-sectional profile about a full perimeter of the lid 420.

Figure 9:
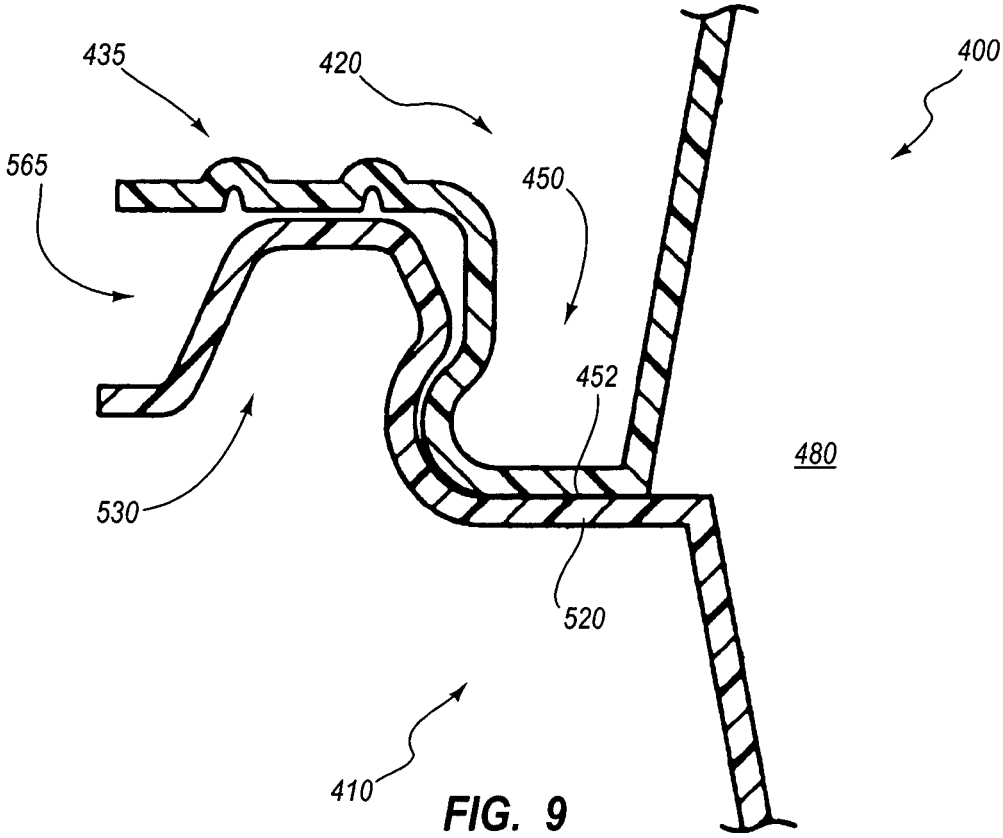
FIG. 9 is a cross-sectional view of a non-venting region of an embodiment of a container compatible with the lid of FIG. 8 shown under relatively low pressure conditions inside the container, with the cross-sectional view taken along a view line such as the view line 4-4 shown in FIG. 1 that corresponds with the view line 9-9 of FIG. 8.
Figure 10:
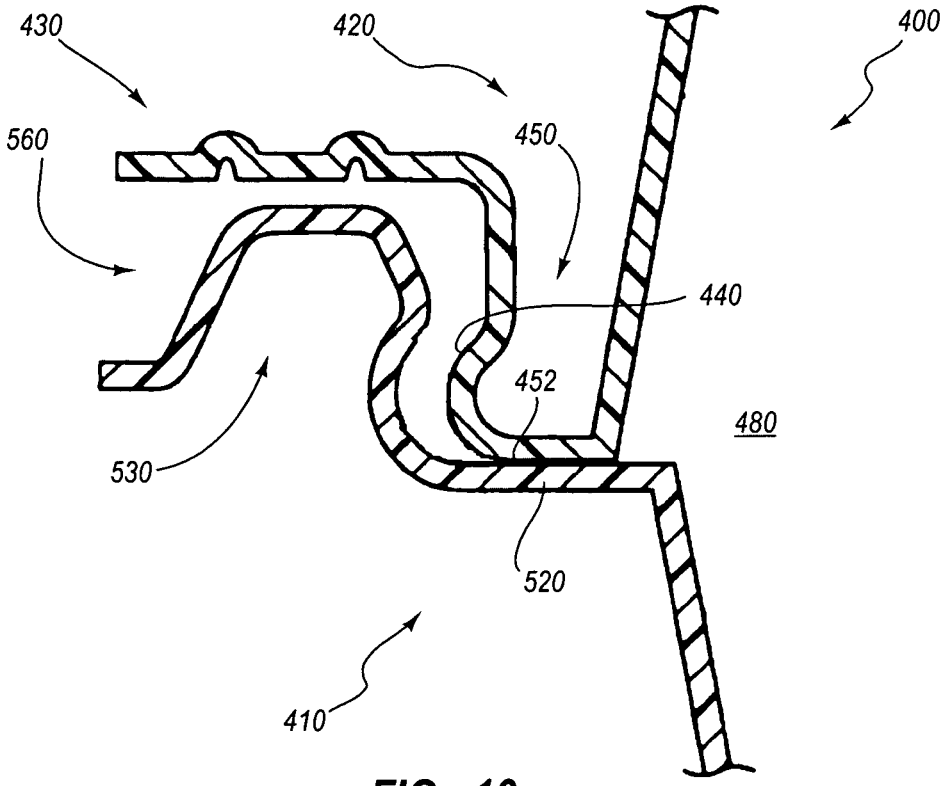
FIG. 10 is a cross-sectional view of a venting region of the container of FIG. 9 under relatively low pressure conditions inside the container taken along a view line such as the view line 5-5 shown in FIG. 1 that corresponds with the view line 10-10 of FIG.8.
Figure 11:
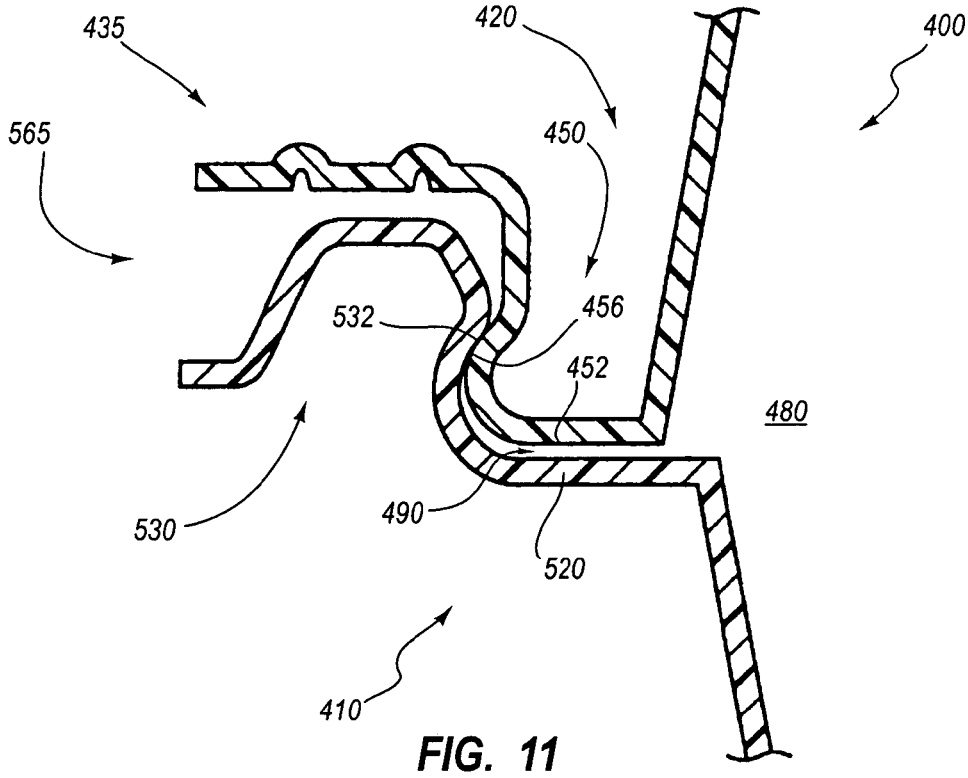
FIG. 11 is a cross-sectional view of a non-venting region of the container of FIG. 9 under relatively high pressure conditions inside the container taken along a view line such as the view line 4-4 shown in FIG. 1 that corresponds with the view line 9-9 of FIG. 8.
Figure 12:
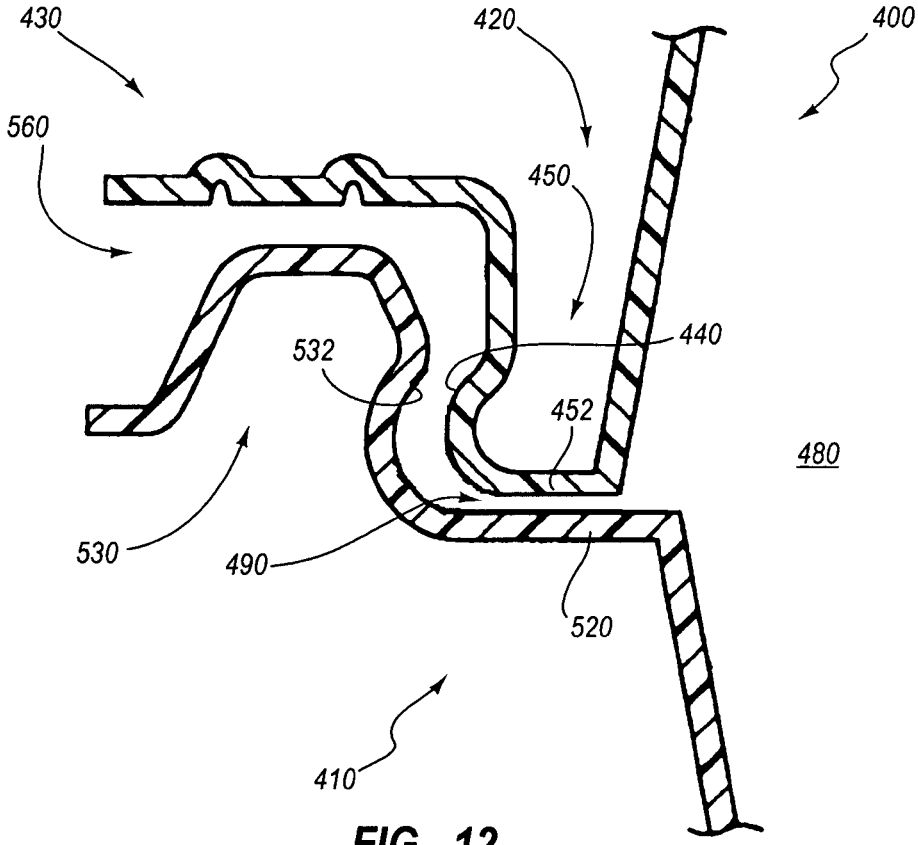
FIG. 12 is a cross-sectional view of a venting region of the container of FIG. 9 under relatively high pressure conditions inside the container taken along a view line such as the view line 5-5 shown in FIG. 1 that corresponds with the view line 10-10 of FIG. 8.

With continued reference to FIGS. 9-12, an embodiment of a container 400 that includes the base 410 and the lid 420 is shown in two operational modes. FIGS. 9 and 10 depict the container 400 in an attached-and-closed configuration and FIGS. 11 and 12 depict the container 400 in an attached-and-vented configuration. FIGS. 9 and 11 depict a non-venting region 565 of the container 400, which includes the non-venting portion 435 of the lid 420, and FIGS. 10 and 12 depict a venting region 560 of the container 400, which includes the venting portion 430 of the lid 420.

As shown in FIG. 9, in certain embodiments, a lower surface 452 of the rim 450 of the lid 420 can interact with a ledge 520 of the base 410 in a manner such as described above with respect to the lower surface 352 of the rim 350 and the ledge 220 of the base 110.

As shown in FIG. 10, in certain embodiments, the depression 440 in the rim 450 can provide an area of increased separation between the lip 530 and the rim 450. However, a sufficient portion of the lower surface 452 may remain in the region of the depression 440 such that a seal can be formed between the lower surface 452 and the ledge 220. Interaction between the lip 530 and the rim 450 in regions that neighbor the depression 440 can provide sufficient force in the region of the depression 440 to maintain the seal in this region, as discussed above.

As shown in FIG. 11, in certain embodiments, pressure generated within an interior volume 480 of the container 400 can urge the lid 420 away from the base 410 such that a channel or gap 490 is formed between the lower surface 452 of the rim 450 and the ledge 520 of the base 410. Interaction between an upper edge 456 of the rim 450 and a lower edge 532 of the lip 530 can prevent the lid 420 from fully separating from the base 410. In further embodiments, the interaction can provide a seal that closes an upper end of the gap 490 in the non-venting region 565. In various embodiments, the seal can be liquid-tight or airtight in the non-venting region 565. The seal can be interrupted by the venting regions 560 such that the seal does not extend continuously about a full perimeter of the container 400.

As shown in FIG. 12, the depression 440 of the rim 450 can provide sufficient clearance between the rim 450 and the lip 530 to provide a passageway through which gas can escape from the interior region 480 of the container 400. The gap 490 can thus provide fluid communication between the interior region 480 of the container 400 and an exterior environment.

Various modifications to containers (such as the containers 100, 400) are possible to achieve different venting characteristics. For example, in some embodiments, the threshold value at which transition between the attached-and-closed state and the attached-and-vented state can be modified by altering the materials used in the construction of the containers or the thicknesses thereof, and/or by altering the configuration and/or number of venting regions (such as the venting regions 130, 430). In some embodiments, a lightweight lid and/or an increased number of vents can reduce the threshold value of the pressure differential.

In certain embodiments, containers can comprise a microwave-safe material. Various embodiments can comprise, for example, polypropylene, polyethylene terephthalate, high density polyethylene, and/or low density polyethylene. Some embodiments of containers can be used in environments other than microwaves, such as, for example, convection ovens. Accordingly, in some embodiments, materials that are not generally suitable for use in a microwave, such as certain metals or foils, can be used.

Various modifications, changes, and variations apparent to those of skill in the art may be made in the arrangement, operation, and details of the apparatus and methods detailed in this disclosure without departing from the spirit and scope of the disclosure. Thus, it is to be understood that the embodiments described above have been presented by way of example, and not limitation. Any suitable combination of the features described above is contemplated and can provide additional embodiments. Moreover, each embodiment recited in the claims that follow is incorporated herein as a separate embodiment.

The invention claimed is:

1. A container assembly comprising:

a base comprising:

a closed bottom surface;

a sidewall that extends upwardly from the closed bottom surface; and a peripheral extension that defines an open top, the peripheral extension extending outwardly from the sidewall about a periphery of the base, the peripheral extension comprising:

an inner ledge;

an outer lip; and one or more venting recesses extending across a portion of the inner ledge and a portion of the outer lip; and a lid removably couplable with the base to close the open top of the base, wherein the lid cooperates with the base to define an interior volume of the container assembly when the lid is coupled with the base, the lid comprising:

a closed top; and a portion extending downwardly from the closed top to a peripheral extension, wherein the peripheral extension extends about a periphery of the lid and comprises a contact surface, wherein the lid cooperates with the base to provide:

a) an attached-and-closed configuration in which the peripheral extension of the lid forms a substantially liquid-tight seal with the peripheral extension of the base that isolates the interior volume of the container assembly from the one or more venting recesses; and b) an attached-and-vented configuration in which the contact surface of the peripheral extension of the lid moves upwardly away from the inner ledge of the base so as to be spaced from the inner ledge by a gap that permits fluid communication between the interior volume of the container assembly and the one or more venting recesses, and wherein the lid automatically transitions from the attached-and-closed configuration to the attached-and-vented configuration upon an increase in a pressure of the internal volume of the container assembly.

2. The container of claim 1, wherein the outer lip extends about a full periphery of the base, and wherein the outer lip extends outwardly from the inner ledge of the base.

3. The container of claim 1, wherein the lid is free of openings between an interior surface and an exterior surface thereof such that the lid substantially prevents fluid communication between the interior volume and an environment outside of the container when the lid is in the attached-and-closed configuration.

4. The container of claim 1, wherein:

the peripheral extensions of the base and lid comprise complementary transition regions that are configured to interact with each other to maintain the lid coupled with the base in the attached-and-vented configuration;

a plurality of connection regions are defined by areas at which the transition regions of the lid and the base contact each other when the lid is coupled to the base; and each of the one or more venting recesses defines a venting region at which the transition regions of the lid and the base do not contact each other when the lid is coupled to the base, such that the container comprises one or more venting regions, wherein the connection regions account for a substantially greater portion of a perimeter of the container than do the one or more venting regions.

5. The container of claim 1, wherein the peripheral extensions of the base and lid comprise complementary transition regions that are configured to interact with each other to maintain the lid coupled with the base in the attached-and-vented configuration, and wherein a contact region between an outwardly facing surface of the transition region of the lid and an inwardly facing surface of the transition region of the base incrementally advances from a position at a bottom end of the transition region of the base to a position at a top end of the transition region of the base as the lid moves from the attached-and-closed configuration to the attached-and-vented configuration.

6. The container of claim 1, wherein the peripheral extension comprises a rim that defines the contact surface, and wherein the rim defines a cross-sectional profile that is the same at every position about the periphery of the lid.

7. The container of claim 1, wherein at least an inner region of the lid moves upwardly away from the bottom surface of the base when the lid moves from the attached-and-closed configuration to the attached-and-vented configuration to thereby create the gap between the contact surface of the lid and the inner ledge of the base.

8. The container of claim 1, wherein the peripheral extensions of the base and lid comprise complementary transition regions that are configured to interact with each other to maintain the lid coupled with the base in the attached-and-vented configuration, and wherein at least one of the one or more venting recesses is positioned so as to separate adjacent sections of the transition region of the base.

9. The container of claim 8, wherein the at least one of the one or more venting recesses and the transition region of the lid cooperate to define a fluid passageway through which gas can egress from the interior volume of the container assembly in the attached-and-vented configuration.

10. A container assembly comprising:

a base comprising:

a closed bottom surface;

a sidewall that extends upwardly from the closed bottom surface; and a peripheral extension at an upper end of the sidewall that defines an open top, the peripheral extension extending outwardly from the sidewall about a periphery of the base, the peripheral extension comprising:

an inner ledge;

an outer lip; and one or more venting recesses extending across a portion of the inner ledge and a portion of the outer lip; and a lid that comprises an inner region and is removably couplable with the base to close the open top of the base, wherein the lid cooperates with the base to define an interior volume of the container assembly when the lid is coupled with the base, the lid comprising:

a closed top, wherein the inner region comprises the closed top; and a portion extending downwardly from the closed top to a peripheral extension, wherein the peripheral extension extends about a periphery of the lid and comprises a contact surface, wherein the lid cooperates with the base to provide:

a) an attached-and-closed configuration in which the peripheral extension of the lid forms a substantially liquid-tight seal with the peripheral extension of the base that isolates the interior volume of the container assembly from the one or more venting recesses; and b) an attached-and-vented configuration in which the inner region of the lid moves upwardly away from the bottom surface of the base and the contact surface of the peripheral extension of the lid moves upwardly away from the inner ledge of the base by a gap that permits fluid communication between the interior volume of the container assembly and the one or more venting recesses, and wherein the lid automatically transitions from the attached-and-closed configuration to the attached-and-vented configuration upon an increase in a pressure of the internal volume of the container assembly.

11. The container of claim 10, wherein the inner region of the lid is at a higher position, relative to the bottom surface of the base, as compared with the peripheral extension of the lid, when the lid is in the attached-and-vented configuration.

12. The container of claim 10, wherein the peripheral extensions of the base and lid comprise complementary transition regions that are configured to interact with each other to maintain the lid coupled with the base in the attached-and-vented configuration, wherein at least one of the one or more venting recesses separates adjacent sections of the transition region of the base, and wherein the at least one of the one or more venting recesses and the transition region of the lid cooperate to define a fluid passageway through which gas can egress from the interior volume of the container assembly in the attached-and-vented configuration.

13. The container of claim 10, wherein the peripheral extensions of the base and lid comprise complementary transition regions that are configured to interact with each other to maintain the lid coupled with the base in the attached-and-vented configuration, wherein each of the transition regions is rounded so as to define a radius of curvature, and wherein the transition region of the lid fits snugly within the transition region of the base when the lid is in each of the attached-and-closed and the attached-and-vented configurations.

14. The container of claim 10, wherein the peripheral extensions of the base and lid comprise complementary transition regions that are configured to interact with each other to maintain the lid coupled with the base in the attached-and-vented configuration, and wherein a contact region between an outwardly facing surface of the transition region of the lid and an inwardly facing surface of the transition region of the base incrementally advances from a position at a bottom of the transition region of the base to a position at a top end of the transition region of the base as the lid moves from the attached-and-closed configuration to the attached-and-vented configuration.

15. A container assembly comprising:

a base comprising:

a closed bottom surface;

a sidewall that extends upwardly from the closed bottom surface; and a peripheral extension that defines an open top, the peripheral extension extending outwardly from the sidewall about a periphery of the base, the peripheral extension comprising:

an inner ledge;

an outer lip that comprises a transition region that defines an inwardly facing surface; and one or more venting recesses extending across a portion of the inner ledge and a portion of the outer lip; and a lid removably couplable with the base to close the open top of the base, wherein the lid cooperates with the base to define an interior volume of the container assembly when the lid is coupled with the base, the lid comprising:

a closed top; and a portion extending downwardly from the closed top to a peripheral extension, wherein the peripheral extension extends about a periphery of the lid and comprises an inner rim that comprises:

a contact surface; and a transition region that defines an outwardly facing surface that is complementary to the inwardly facing surface of the transition region of the base, wherein the lid cooperates with the base to provide:

a) an attached-and-closed configuration in which the contact surface of the inner rim of the lid cooperates with the inner ledge of the base to form a substantially liquid-tight seal that isolates the interior volume of the container assembly from the one or more venting recesses; and b) an attached-and-vented configuration in which the contact surface of the inner rim of the lid moves upwardly away from the inner ledge of the base so as to be spaced from the inner ledge by a gap that permits fluid communication between the interior volume of the container assembly and the one or more venting recesses, and wherein the lid automatically transitions from the attached-and-closed configuration to the attached-and-vented configuration upon an increase in a pressure of the internal volume of the container assembly.

16. The container of claim 15, wherein an innermost region of the lid is at a higher position, relative to the bottom surface of the base, as compared with each of the contact surface and the transition region of the lid when the lid is in the attached-and-vented configuration.

17. The container of claim 15, wherein at least one of the one or more venting recesses in the base separates adjacent sections of the transition region of the base, and wherein the at least one of the one or more venting recesses and the transition region of the lid cooperate to define a fluid passageway through which gas can egress from the interior volume of the container assembly.

18. The container of claim 15, wherein the rim defines a cross-sectional profile that is the same at every position about the periphery of the lid.

* * * * *